United States Patent [19]

Radd

[11] 4,285,615

[45] Aug. 25, 1981

[54] CORROSION RESISTANT TENSION LEG CABLES

[75] Inventor: Frederick J. Radd, Ponca City, Okla.

[73] Assignee: Conoco, Inc., Ponca City, Okla.

[21] Appl. No.: 968,881

[22] Filed: Dec. 13, 1978

[51] Int. Cl.[3] ..... B63B 35/44; E02B 17/00

[52] U.S. Cl. ..... 405/211; 174/11 R; 114/265; 405/224

[58] Field of Search ..... 405/195, 211, 224, 154, 405/158; 174/11 R, 24; 114/264, 265

[56] References Cited

U.S. PATENT DOCUMENTS

| | | | |
|---|---|---|---|
| 2,004,769 | 6/1935 | Shanklin | 340/242 |
| 2,105,168 | 1/1938 | Staples | 174/102 |
| 2,142,625 | 1/1939 | Zoethout | 174/106 |
| 2,438,441 | 3/1948 | Hollingsworth | 340/242 |
| 3,086,069 | 4/1963 | Kolmorgen | 174/11 R |
| 3,300,573 | 1/1967 | Ronald et al. | 174/106 |
| 3,339,012 | 8/1967 | Hutchins | 174/128 |
| 3,457,717 | 7/1969 | Durkee et al. | 57/149 |
| 3,517,517 | 6/1970 | Blenkarn | 405/225 |
| 3,800,522 | 4/1974 | Hughes | 57/149 |
| 3,979,896 | 9/1976 | Klett et al. | 57/149 |

*Primary Examiner*—David H. Corbin

*Attorney, Agent, or Firm*—A. Joe Reinert

[57] ABSTRACT

A tension leg cable is connected between a floating structure and a seafloor anchor means. The cable is a multi-strand cable having voids between adjacent strands. A fluid tight vulcanized rubber sheath is provided covering an outer surface of the cable. A fluid tight corrosion resistant tubular member surrounds said sheath so as to define an annular space between the tubular member and the sheath. Means is provided for supplying an inert gas under pressure to said voids and said annular space. Means is provided for monitoring the pressure of said inert gas in said voids and said annular space to detect changes in said pressure so as to indicate a leak in either said sheath or said tubular member. Methods of construction of said tension leg cable are also disclosed.

20 Claims, 7 Drawing Figures

CORROSION RESISTANT TENSION LEG CABLES

BACKGROUND OF THE INVENTION

1. Field of the Invention

This invention relates generally to tension leg cables for use with tension leg platforms, and more particularly, but not by way of limitation, to a multi-strand cable having a vulcanized rubber sheath covering said cable with an inert gas under pressure provided to voids between strands of said cable.

2. Description of the Prior Art (Prior Art Statement)

The following is intended to be a prior art statement in accordance with the guidance and requirements of 37 C.F.R. §§ 1.56, 1.97 and 1.98.

U.S. Pat. No. 3,517,517 to Blenkarn discloses a cable for use in tethering a tension leg platform. The system of Blenkarn comprises a wire cable having a metal sheath disposed thereabout and having a fluid such as oil in the annulus between the wire cable and the metal sheath. No disclosure is made of monitoring fluid pressure within the permeable zone within the steel cable itself, or within the annulus between the sheath and the cable.

U.S. Pat. No. 2,438,411 to Hollingsworth, and No. 2,004,769 to Shanklin, each disclose a system for maintaining a positive pressure of a fluid within an annular space between a sealed conduit and an electric cable to prevent entry of corrosive fluids and for insulating purposes. The fluid pressure in the annulus is monitored to detect leaks in the conduit. No disclosure is made of monitoring fluid pressure in the permeable zone or voids within the steel cable itself.

U.S. Pat. No. 3,979,896 to Klett et al. discloses a wire cable having a lubricant entrapped between the strands and sheathed with a plastic sheath. U.S. Pat. No. 3,800,522 to Hughes et al. discloses a wire cable impregnated with a foamed plastic sealant.

U.S. Pat. No. 3,300,573 to Ronald et al. and No. 2,105,168 to Staples disclose electrical cables sheathed with plastic insulation which is in turn covered with a metal sheath.

U.S. Pat. No. 3,457,717 to Durkee et al., No. 3,339,012 to Hutchins, Jr., and No. 2,142,625 to Zoethout are illustrative of the state of the art in sheathed electrical cables.

Thus it is seen that none of these prior art references disclose a tension leg cable having a pressurized fluid within the voids between strands of the cable itself and a means for monitoring the pressure of that fluid to detect leaks in a sheath covering the tension leg cable.

SUMMARY OF THE INVENTION

There is a proposed need to use large steel cables to tether petroleum production platforms in deep waters, such as is encountered in the North Sea. This need arises from the searches for oil and gas into ever deeper seas. It also arises from the need to have high integrity structures at more reasonable costs than those of fixed-leg platforms. The tension leg cable is basically a large diameter steel wire cable which operates under an aerobic seawater corrosion fatigue basis. As a result, the direct use of large wire ropes in sea water is virtually a prohibitive enterprise due to the short performance lifetimes involved. For example, a U.S. Navy paravane cable, which is used to clear out mined waters, sometimes lasts only six days.

The following invention provides a corrosion resistant design for a tension leg cable which isolates the steel wire cable from the sea water environment so as to provide an acceptable working lifetime of the cable.

A tension leg cable is connected between a floating structure and a seafloor anchor means. The cable is a multi-strand cable having voids between adjacent strands. A fluid tight vulcanized rubber sheath is provided covering an outer surface of the cable. A fluid tight corrosion resistant tubular member surrounds said sheath so as to define an annular space between the tubular member and the sheath, and to give armor type protection to the rubber sheath. Means is provided for supplying an inert gas under pressure to said voids and said annular space. Means is provided for monitoring the pressure of said inert gas in said voids and said annular space to detect changes in said pressure so as to indicate a leak in either said sheath or said tubular member. Methods of construction of said tension leg cable are also disclosed.

It is, therefore, a general object of the present invention to provide an improved tension leg design.

Another object of the present invention is the provision of a corrosion resistant structural load carrying cable.

Yet another object of the present invention is the provision of a multi-strand cable covered by a vulcanized rubber sheath with a means for supplying inert gas under pressure to voids between adjacent strands of said cable and a means for monitoring of said gas pressure to detect leaks in said sheath.

Still another object of the present invention is the provision of an improved design for a tension leg platform.

And another object of the present invention is the provision of a tension leg cable having a vlucanized rubber sheath about the cable and a tubular member enclosing the rubber sheath to define an annular space between the sheath and tubular member to which annular space is provided an inert gas under pressure which is monitored to detect leaks in said tubular member.

Other and further objects, features and advantages of the present invention will be readily apparent to those skilled in the art from a reading of the description of preferred embodiments which follows when taken in conjunction with the accompanying drawings.

DETAILED DESCRIPTION OF THE PREFERRED EMBODIMENTS

Figure 1:
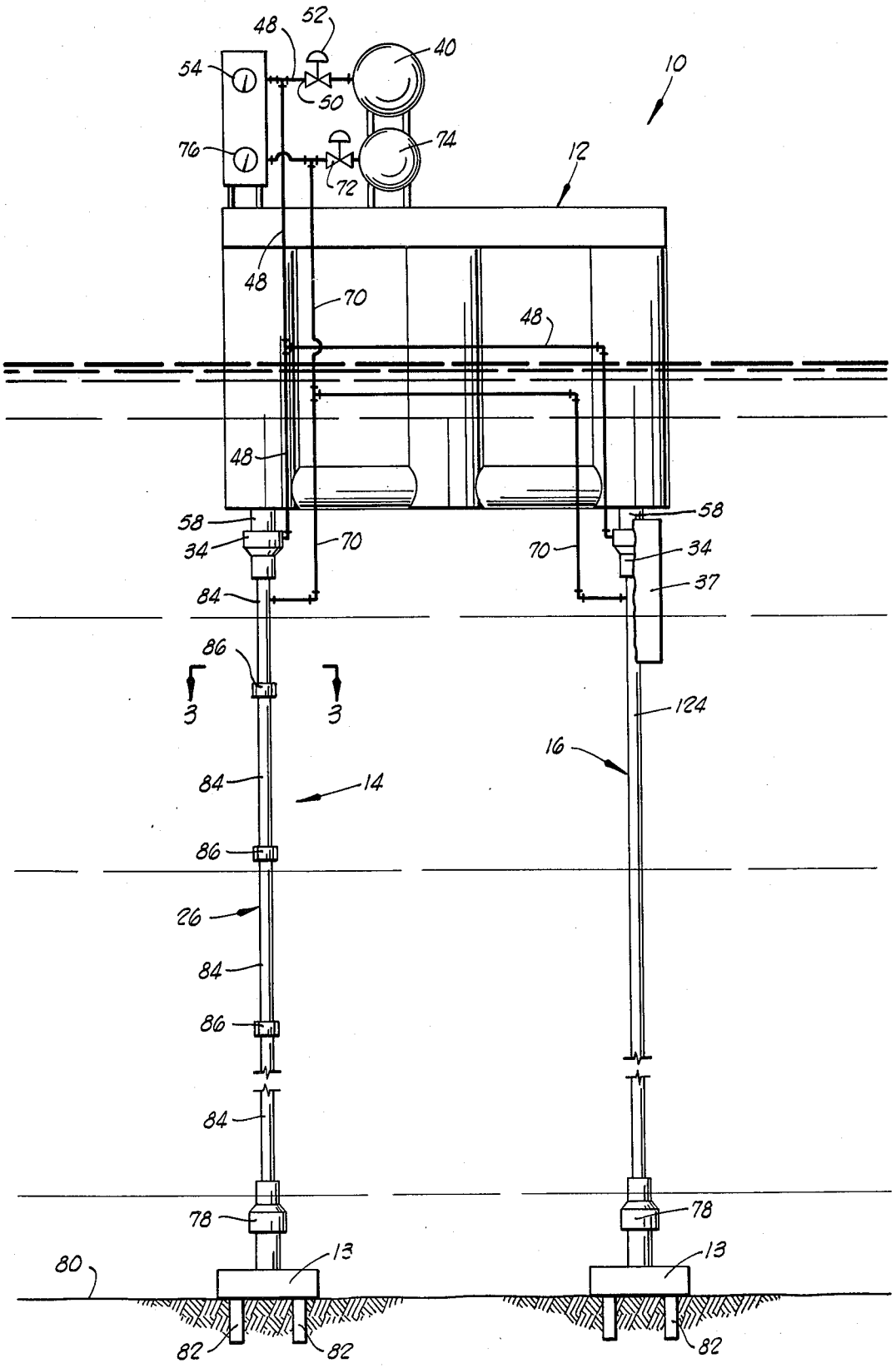
FIG. 1 shows a schematic elevation view of a tension leg platform including the tension leg cables of the present invention. The left side of FIG. 1 illustrates a tension leg having a tubular member comprised of a plurality of tubular elements connected by fluid tight connectors. The right side of FIG. 1 illustrates a tension leg cable having a tubular member comprised of a spiral wound and welded metal sheet.

Referring now to the drawings and particularly to FIG. 1, the tension leg platform of the present invention is shown and generally designated by the numeral 10. The tension leg platform 10 includes a floating structure 12 connected to a plurality of seafloor anchors 13 by tension leg cable assemblies 14 and 16. Several tension leg cable assemblies 14 or 16 may be attached to each corner of structure 12 to provide redundant supports.

The general scheme of a tension leg platform 10 comprises locating the floating structure 12, in a heavily ballasted condition, over the seafloor anchor 13. Vertical legs, such as 14 or 16, are then connected between the floating structure 12 and anchor 13. Then the floating structure 12 is deballasted to place a tension preload on legs 14 and 16 due to the buoyant effect of the floating structure 12. This tension preload is of sufficient magnitude that the legs 14 and 16 remain in tension when the structure 12 is subjected to the undulations of ocean waves.

Tension leg cable assemblies 14 and 16 illustrate two separate embodiments of the present invention, which invention can generally be said to comprise a mooring system for a structure floating upon a body of water. The details of construction of these tension leg cable assemblies are more clearly shown in FIGS. 2–7.

Each of the tension leg cable assemblies 14 and 16 comprises a corrosion resistant cable system. The tension leg cable assembly 14 includes a multi-strand cable 18 having voids 20 between adjacent strands 22.

Preferably cable 18 is formed from an ultra-low impurity steel having as low a concentration as possible of sulfur and phosphorous. Such a cable 18 would last longer than a cable of a higher impurity steel if the coverings described below were to fail and expose cable 18 to the ocean environment.

A fluid tight vulcanized rubber sheath or covering 24 engages an outer surface of cable 18.

A fluid tight tubular member 26 surrounds sheath 24 to define an annular space 28 between sheath 24 and inner surface 30 of tubular member 26. Sheath 24 may be described as being received within tubular member 26. Tubular member 26 serves both as a mechanical shield to prevent damage to rubber sheath 24 as might be caused by impact with a tugboat, and as a fluid tight container to hold a pressurized fluid in annular space 28. Pressure in that space 28 may be monitored, as is further explained below, to check for leaks in tubular member 26.

An upper end 32 of cable 18 is connected to a first connector means 34 for connecting cable 18 to floating structure 12. First connector means 34 is a swaged ferrule having a cylindrical portion 36 tightly engaging the outer surface of cable 18 adjacent said upper end 32, so that said first connector means 34 transmits a buoyant force from said floating structure 12 to said cable 18. Connector means 34 also serves to seal off upper end 32 of the multi-strand cable 18 to prevent wicking of the fluid environment into the voids 20.

Preferably, some additional mechanical protection is provided near upper end 32 of cable 18 by means of a zero buoyancy bumper 37. Bumper 37 may be constructed from polyethylene or polypropylene. That material is preferably formulated so as to have a density approximately equal to that of seawater so that there will be no buoyancy effect from the bumper to affect the loading of cable 18.

First connector means 34 has a port 38 disposed therein for communicating the voids 20 of cable 18 with a first source 40 of inert gas under pressure.

First end 42 of port 38 communicates with an internal bore of cylindrical portion 36 adjacent an upper end of voids 20. A second end 44 of port 38 is connected to a first fluid connector fitting 46 which is attached to a first conduit 48. First conduit 48 is connected to the downstream end 50 of a first pressure regulator 52. The upstream side of pressure regulator 52 is connected to first source 40 of fluid under pressure. A first pressure gauge 54, or other pressure monitoring means, is connected to first conduit 48 so as to indicate pressure of the inert gas in the voids 20 of cable 18.

First connector means 34 includes a socket 56 for receiving a lug 58 which is attached to floating structure 12. A bolt 60 is disposed in a transverse bore 62 of first connector means 34. Bolt 60 is placed through a transverse bore 64 of lug 58 so as to connect lug 58 with first connector 34.

Tubular member 26 has a hole 66 diposed in a side thereof. A second fluid connector fitting 68 communicates with hole 66 and with inner cavity or annular space 28 between sheath 24 and tubular member 26.

A second conduit 70 is connected to second fluid connector fitting 68 and to the downstream side of a second pressure regulator 72. The upstream side of pressure regulator 72 is connected to a second source 74 of fluid under pressure. Second conduit 70 is also connected to a second pressure gauge 76 or other means of monitoring the pressure of inert gas in the annular space 28 between sheath 24 and tubular member 26.

The fluid in sources 40 and 74 is a corrosion retarding protective fluid which is preferably an inert gas, such as nitrogen or argon.

The pressure gauges 54 and 76 provide a monitoring means for determining when the fluid pressure in the voids 20 or the annular space 28 changes.

A lower end of cable 18 is connected to a second connector means 78 for connecting cable 18 to anchor means 14. Anchor means 13 are attached to the ocean floor 80 by suitable pilings 82.

It is necessary that annular space 28 be sealed off at its ends adjacent upper and lower connector means 34 and 78. This may be accomplished, for example, by welding tubular member 26 to upper connector means 34 as indicated at 83 in FIG. 2.

Figure 3:
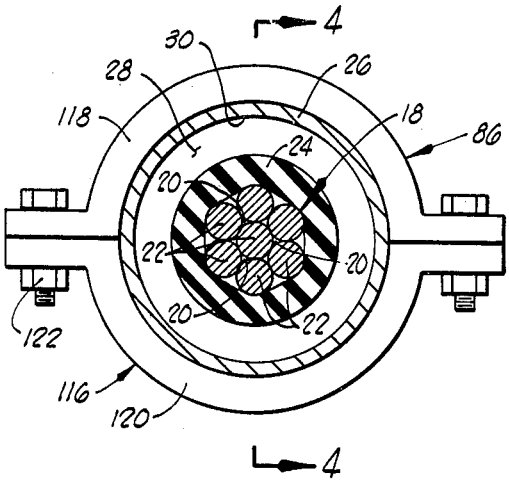
FIG. 3 is a sectional view of the tension leg cable of the left side of FIG. 1 taken about line 3—3.
Figure 4:
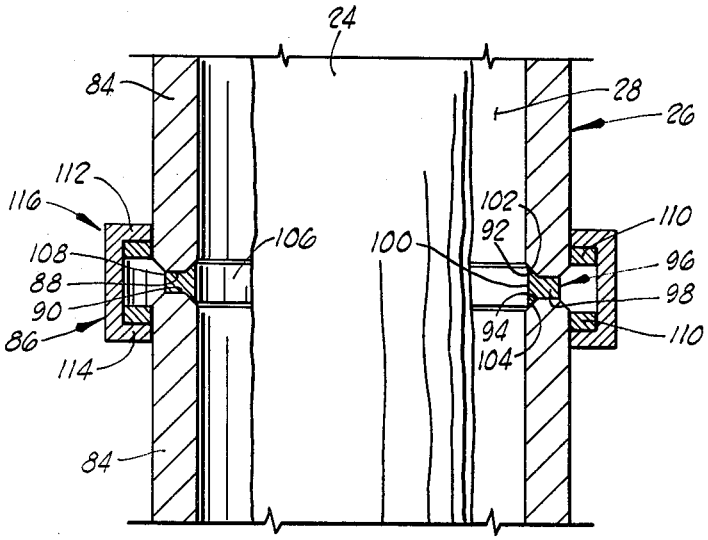
FIG. 4 is a sectional elevation view of the tension leg cable of FIG. 3 taken about line 4—4.

The tubular member 26 is comprised of a plurality of tubular elements 84 with fluid tight connecting means 86 between adjacent tubular elements. The details of construction of the fluid tight connecting means 86 are shown in FIGS. 3 and 4. Connecting means 86 is of a type commonly referred to as a Bridgeman seal. Its general construction is old in the art, although it is not believed to have previously been used in combination with a tension leg cable assembly.

All metal elements of the present invention exposed to the ocean environment are preferably constructed from K-Monel, Inco 625 alloy, or other suitable corrosion resistant metal.

Referring specifically to FIG. 4, a lower end 88 of an upper first tubular element 84 is connected to an upper end 90 of a second lower adjacent leg element 84 as follows. Each of the ends 88 and 90 includes an inner annular bevel 92 and 94, respectively. An annular expandible sealing ring 96 has a horizontal lip portion 98 and a radially inner thicker portion 100. The thicker portion 100 has upper and lower annular radially outward facing beveled portions 102 and 104, respectively. Upper and lower bevels 102 and 104 of sealing ring 96 are partially coextensive with and sealingly engage inner annular bevels 92 and 94, respectively. Due to the greater surface area of radially inner surface 106 of sealing ring 96 as opposed to the radially outer surface 108 of sealing ring 96, the pressure of the inert gas within annular space 28 causes sealing ring 96 to be urged radially outward. This radially outward force causes upper and lower bevels 102 and 104 to tightly and sealingly engage inner annular bevels 92 and 94, respectively. At the same time, the wedging effect of these engaging beveled surfaces tends to force the adjacent tubular elements 84 axially apart.

Adjacent each of the upper and lower ends 88 and 90 of tubular elements 84 are radially outward projecting ledges 110, which are fixedly attached to tubular elements 84. Engaging ledges 110 are upper and lower radially inward projecting annular lips 112 and 114 of an annular connecting means cap 116. Cap 116 prevents the adjacent tubular elements 84 from being moved axially apart.

Referring to FIG. 3, it is seen that cap 116 is comprised of first and second semi-circular halves 118 and 120 which are connected together by bolts 122 or other suitable connectors.

The construction of tension leg cable 16, as shown schematically on the right-hand side of FIG. 1, is similar to that of tension leg cable assembly 14 except for the construction of the tubular members. Tension leg assembly 16 includes a spiral wound tubular member 124. A sectional view similar to that of FIG. 3 taken through tension leg cable assembly 16 would be identical to FIG. 3 except that there would be no connecting means 86.

Figure 5:
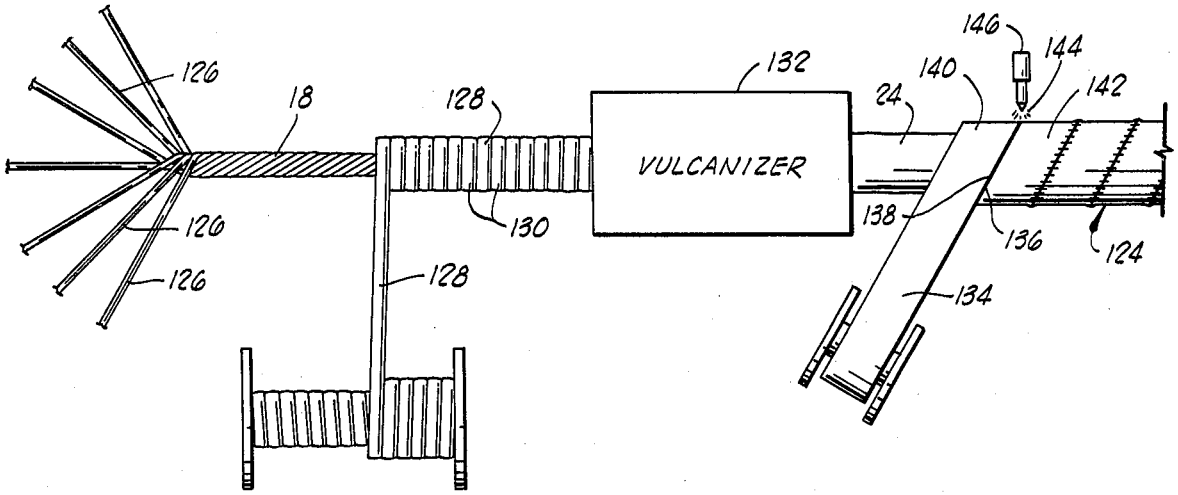
FIG. 5 is a schematic representation of a method of construction of the tension leg cable shown on the right side of FIG. 1 with a spiral wound and welded tubular member.

Referring now to FIG. 5, the details of construction of the tension leg cable assemblies 14 and 16, and more particularly the details of construction of spiral wound tubular member 124 are illustrated.

FIG. 5 is a schematic illustration showing the various steps in construction of one of the corrosion-resistant cable systems like assemblies 14 and 16.

Very long lengths may be required for the cables 18. It is conceivable that they could be required to have a length of as much as two or three thousand feet. Steel wire fibers having lengths of as much as 7500 feet are currently available. Due to these lengths, and the size of the cables which will be required for mooring a very large off-shore platform, it is very probable that the tension leg cable assemblies will have to be constructed on the job site.

First, the cable 18 is wound from a plurality of individual cable elements 126. FIG. 5 illustrates a conventional spiral wound type cable. As is further described below, an alternative embodiment of the present invention provides a cable comprised of an array of straight parallel bundled steel wire fibers.

Then a flexible rubber member 128 is wrapped about cable 18. Flexible rubber member 128 is preferably a very long rubber cylinder having a diameter of at least one inch. Rubber member 128 is wrapped about cable 18 in a spiral manner with adjacent spirals 130 being packed closely together.

Then a portion of cable 18 with the flexible member 128 wrapped thereabout is placed in vulcanizing means 132 and subjected to appropriate pressure and temperature conditions to form the continuous fluid tight vulcanized rubber sheath 24. Vulcanizing means 132 may also include a suitable die or mold for aiding the forming of the continuous rubber sheath 24.

For the tension leg cable assembly 16, the spiral wound tubular member 124 is formed by winding a sheet of metal 134 in a spiral about sheath 24 as illustrated at the right hand side of FIG. 5. Then edges 136 and 138 of adjacent spirals 140 and 142 are welded together at 144 by a welding machine 146.

Figure 6:
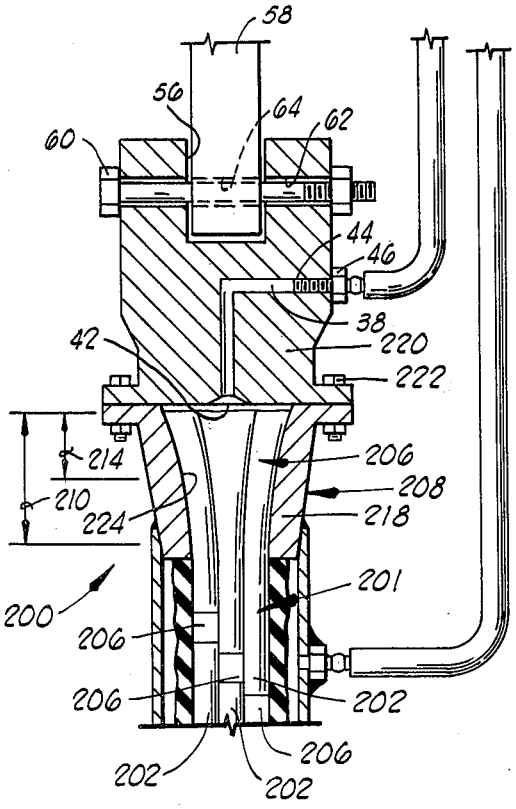
FIG. 6 is a sectional view similar to FIG. 2, showing an upper end connector means for use with a parallel fiber steel cable having a broomed and braided end.
Figure 7:
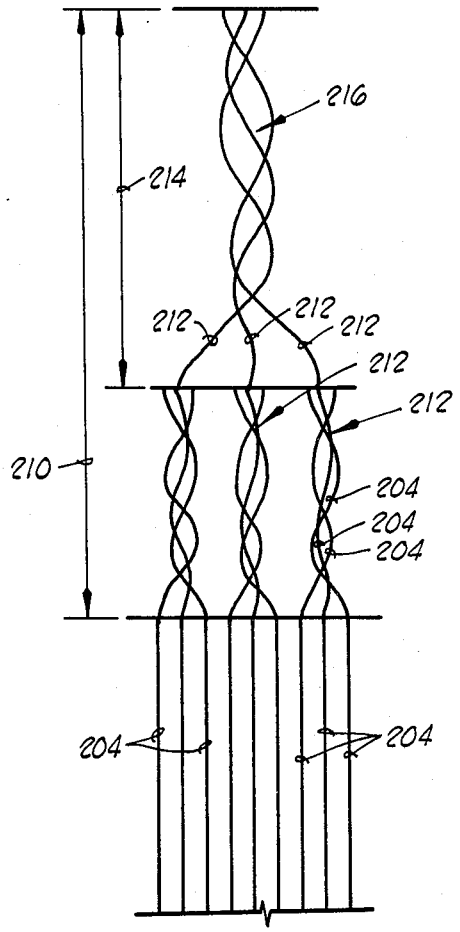
FIG. 7 is a schematic representation of the manner in which the ends of the parallel fibers of the cable of FIG. 6 are braided together.

Referring now to FIGS. 6 and 7, an alternative embodiment of a tension leg cable assembly of the present invention is shown and generally designated by the numeral 200. Tension leg cable assembly 200 includes a cable 201 comprised of an array of bundles 202 of straight parallel wire fibers 204. It will be appreciated that the parallel fiber cable 201 may be used with either type of tubular member 26 or 124.

It is sometimes preferable to use the parallel fiber cable 201, as opposed to conventional spiral wrapped cable 18, because of the lesser elasticity of the parallel fiber cable 201. A parallel fiber cable 201 will reduce the vertical movement or heave experienced by floating structure 12 when it is subjected to wave motions.

Each bundle 202 of fibers 204 includes a large number of parallel fibers 204 packed closely together like a bundle of straws and hold together by a plurality of annular bands 206 which are regularly spaced along the length of each bundle 202.

A cross-sectional view of tension leg cable assembly 200 would appear similar to FIG. 3, except that the bands 206 would be seen in place about each of the bundles 202.

The parallel fiber cable 201, however, requires a different type of end connection to transmit tensile forces between the cable and the floating structure 12. This is because the parallel fibers 204 do not effectively transmit forces across the cross-section of the cable 201 unless the fibers 204 are somehow tied together.

An effective end connection is provided by "brooming and braiding" the cable end 206 and receiving the broomed and braided end 206 in a special connector means 208.

The brooming and braiding is best described with reference to FIG. 7. A length 210 of cable end 206 is "broomed", that is the fibers 204 are separated. Then each fiber 204 is braided together with two adjacent fibers 204 to form single braided portions 212. Then a length 214 of each single braided portion 212 is braided together with two adjacent single braided portions 212 to form a double braided portion 216. For some applications, it may be preferable to only single braid the ends of cable 201.

It will be appreciated that the cross-sectional area occupied by a single braided portion 212 will be greater than that of the three fibers 204 from which it is formed. Similarly, the area occupied by a double braided portion 216 will be greater than that of the three single braided portions 212 from which it is formed, so that the broomed and braided end 206 of cable 201 has an enlarging taper as shown in FIG. 6.

Upper end connector means 208 includes first and second portions 218 and 220 connected by a plurality of bolts 222.

First upper end connector portion 218 includes a downwardly tapered radially inner surface 224. First portion 218 is placed about cable 201 prior to brooming and braiding end 206. The enlarged end 206 is closely received by inner surface 224 as shown in FIG. 6 so that it is not possible to pull cable 201 downwardly out of connector portion 218. The greater the tensile force on cable 201, the more tightly end 206 is wedged into lower connector portion 218.

Figure 2:
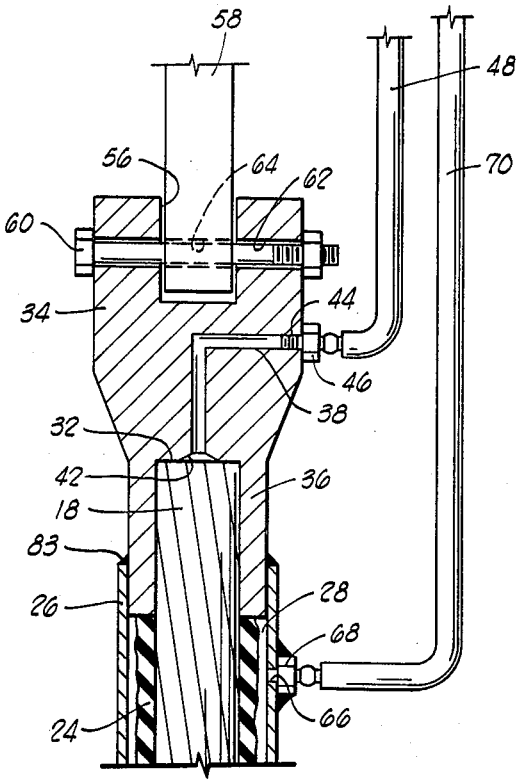
FIG. 2 is a sectional elevation view of an upper end connector means of the tension leg cable of the present invention, for use with a conventional spiral wound type cable.

Upper portion 220 of connector 206 is constructed similarly to the analagous portion of connector 34 of FIG. 2 with like numerals indicating like parts.

Thus, the tension leg cables of the present invention are well adapted to carry out the objects and attain the ends and advantages mentioned as well as those inherent therein. While prsently preferred embodiments of the invention have been described for the purpose of this disclosure, numerous changes in the construction and arrangement of parts can be made by those skilled in the art, which changes are encompassed within the spirit of this invention as defined by the appended claims.

The embodiments of the invention in which an exclusive property or privilege is claimed are defined as follows:

1. A mooring system apparatus for a structure floating on a body of water, comprising:
- a corrosion resistant cable system, including:
  - a multi-strand cable, having voids between adjacent strands;
  - a fluid tight covering engaging an outer surface of said cable;
  - a means for supplying fluid under pressure directly to said voids; and
  - a fluid pressure monitoring means, for continuously monitoring said fluid pressure in said voids and determining when said fluid pressure in said voids changes;
- a first connector means, connected to an upper end of said cable, for connecting said cable to said floating structure; and
- a second connector means, connected to a lower end of said cable, for connecting said cable to an anchor means attached to a floor of said body of water.

2. Apparatus of claim 1, wherein:
- said fluid tight covering is comprised of vulcanized rubber.

3. Apparatus of claim 1, wherein:
- said fluid under pressure is an inert gas.

4. Apparatus of claim 3, wherein said inert gas is nitrogen.

5. Apparatus of claim 3, wherein said inert gas is argon.

6. Apparatus of claim 1, wherein:
- said first connector means is a swaged connector having a cylindrical portion tightly engaging an outer surface of said cable adjacent said upper end, so that said first connector means transmits a buoyant force from said floating structure to said cable.

7. Apparatus of claim 6, wherein:
- said first connector means has a port disposed therein communicating said voids with said fluid supplying means.

8. Apparatus of claim 1, wherein:
- each strand of said cable includes a bundle of parallel fibers, with the fibers being braided at said upper end of said cable so as to tie adjacent fibers together and form an enlarged end on said cable; and
- said first commector means includes a downwardly tapered radially inner surface for closely receiving said enlarged upper end of said cable.

9. Apparatus of claim 8, wherein:
- said first connector means has a port disposed therein communicating said voids with said fluid supplying means.

10. A mooring system apparatus for a structure floating on a body of water, comprising:
- a corrosion resistant cable system, including:
  - a multi-strand cable, having voids between adjacent strands;
  - a fluid tight covering engaging an outer surface of said cable;
  - a means for supplying fluid under pressure to said voids; and
  - a fluid pressure monitoring means, for determining when said fluid pressure in said voids changes;
- a first conector means, connected to an upper end of said cable, for connecting said cable to said floating structure;
- a second connector means, connected to a lower end of said cable, for connecting said cable to an anchor means attached to a floor of said body of water;
- a fluid tight tubular member, within which said covering is received;
- a means for supplying fluid under pressure to a space between said tubular member and said covering; and
- a means for determining when said fluid pressure in said space changes.

11. Apparatus of claim 10, wherein:
- said tubular member is comprised of a spiral wound welded sheet.

12. Apparatus of claim 10, wherein:
- said tubular member comprises a plurality of tubular elements with fluid tight connecting means between adjacent tubular elements.

13. Apparatus of claim 10, wherein:
- said fluid tight covering is comprised of vulcanized rubber.

14. Apparatus of claim 10, wherein:
- said fluid under pressure in said voids and said space is an inert gas.

15. Apparatus of claim 10, wherein:
- said means for supplying said fluid under pressure to said voids is further characterized as a means for supplying fluid under pressure directly to said voids; and
- said fluid pressure monitoring means is further characterized as a means for continuously monitoring said fluid pressure in said voids and determining when said fluid pressure in said voids changes.

16. A tension leg platform mooring system, comprising:
- a floating structure;
- a seafloor anchor;
- a tension leg cable connected between said floating structure and said seafloor anchor, said cable being a multi-strand cable having voids between adjacent strands;
- a fluid tight vulcanized rubber sheath covering said cable;

a means for supplying an inert gas under pressure directly to said voids; and a means for continuously monitoring said gas pressure in said voids and determining when said gas pressure in said voids changes to indicate a leak in said sheath.

17. A tension leg platform mooring system, comprising:

a floating structure;

a seafloor anchor;

a tension leg cable connected between said floating structure and said seafloor anchor, said cable being a multi-strand cable having voids between adjacent strands;

a fluid tight vulcanized rubber sheath covering said cable;

a means for supplying an inert gas under pressure to said voids;

a means for determining when said gas pressure in said voids changes, to indicate a leak in said sheath;

a fluid tight corrosion resistant tubular member, surrounding said sheath;

a means for supplying inert gas under pressure to a space between said tubular member and said sheath; and a means for determining when said gas pressure in said space changes, to indicate a leak in said covering.

18. A method of mooring a tension leg platform, said method comprising the steps of:

connecting a cable between a floating structure and a seafloor anchor means, said cable including a plurality of strands with voids between adjacent strands and a fluid tight sheath surrounding said plurality of strands;

supplying an inert gas under pressure directly to said voids between said adjacent strands of said cable; and continuously monitoring said gas pressure in said voids to detect any leaks in said sheath.

19. Method of claim 18, further comprising:

braiding together parallel fibers of said cable to form an enlarged end thereon.

20. Method of claim 19, further comprising:

connecting said enlarged end of said cable to said floating structure by closely receiving said enlarged end in engagement with a downwardly tapered radially inner surface of an upper end connector means attached to said floating structure.

* * * * *